US006888075B2

(12) United States Patent
Iwakiri

(10) Patent No.: US 6,888,075 B2
(45) Date of Patent: May 3, 2005

(54) PUSH-BUTTON SWITCH

(75) Inventor: Norio Iwakiri, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/373,190

(22) Filed: Feb. 26, 2003

(65) Prior Publication Data

US 2003/0234169 A1 Dec. 25, 2003

(30) Foreign Application Priority Data

Mar. 1, 2002 (JP) ..... 2002-055478

(51) Int. Cl.[7] ..... H01H 25/04
(52) U.S. Cl. ..... 200/5 R; 200/5 A
(58) Field of Search ..... 200/520–537, 200/6 A, 553, 554, 5 R, 5 A

(56) References Cited

U.S. PATENT DOCUMENTS 4,795,862 A * 1/1989 Linden ..... 200/6 A
5,498,843 A * 3/1996 Date et al. ..... 200/6 A
5,621,196 A * 4/1997 Nishijima et al. ..... 200/6 A
5,889,242 A * 3/1999 Ishihara et al. ..... 200/6 A
6,335,496 B1 * 1/2002 Miyashita ..... 200/5 R

FOREIGN PATENT DOCUMENTS

EP 1063664 A2 * 12/2000 ..... H01H/25/04

* cited by examiner

*Primary Examiner*—Lincoln Donovan
*Assistant Examiner*—M. Fishman
(74) *Attorney, Agent, or Firm*—Foley & Lardner LLP

(57) ABSTRACT

A plurality of operation members, each having an operation end and a switch-operating actuation end, are placed on a plane in a dispersed manner so as to freely rock independently, and the operation ends of the operation members are placed so as to face operation plungers at a plurality portions, and in this arrangement, the actuation ends of the respective operation members are connected to a switch main body 4 through a common reset spring plate so that when any one of the operation members is rocked and shifted, the switch main body is actuated.

8 Claims, 13 Drawing Sheets

PRIOR ART

PRIOR ART

PUSH-BUTTON SWITCH

BACKGROUND OF THE INVENTION

1. Field of the Invention

The present invention relates to a push-button switch, and more specifically concerns a push-button switch that is desirably applied to a direction-indicating switch to be attached to a wall face at an elevator hatchway so as to give a going-up or going-down indication.

2. Description of the Background Art

FIG. 14 is a cross-sectional view that shows a push-button switch which is used for a conventional direction-indicating switch for an elevator, and FIG. 15 shows an exploded perspective view thereof.

The above-mentioned push-button switch is constituted by a base member 30 having a box shape with a button hole 30*a*, an operation plunger 31 to be assembled in the button hole 30*a*, reset springs 32 that act on four corners of the operation plunger 31, a base plate 33 that is screw-connected to the base member 30 from the rear face thereof, etc., and a cap 34 made of a light-transmitting material is attached to the operation plunger 31 with a switch unit 35, an LED 36, a light-shielding case 37 having a square tube shape, etc. being assembled on the base plate 33.

The above-mentioned switch unit 35 is constituted by electrodes 38, 39 pairs of which are attached to four corners on the base plate 33, and conductive portions 41 which are attached to four portions on the lower face of a rubber operation member 40 on the base plate 33, and when the operation plunger 31 is pressed against the reset springs 32 through the cap 34, any one of operation protrusions 31*a* that are placed on the four corners of the operation plunger 31 is allowed to press the rubber operation member 40 so as to be shifted so that the conductive portions 41 are made in press-contact with opposing paired electrodes 38, 39 to be switched on; thus, the LED 36 is lighted on to illuminate the cap 34 while a switching output is externally supplied.

Such a conventional push-button switch has a structure in which the shift of the operation plunger 31 is guided by the inner wall face of the button hole 30*a* in the base member 30; therefore, in the case when a thinner structure is provided by shortening the guiding length, the pressing process of the end of the operation plunger 31 causes a one-side pressed state (one-corner pressed state) in which the operation plunger 31 is pushed and shifted in a tilted manner. Consequently, it is necessary to attach the switch units 35 to four portions so as to deal with this one-side pressed state.

When the switch units 35 are individually placed at the four portions as described above, differences tend to occur in the switching characteristics of the respective switch units 35, resulting in a difference in the operation load for turning the switch on depending on the one-side pressed portions. Moreover, since the clicking touch of the operation is obtained by the rubber operation member 40 forming the switch units 35, it is difficult to provide a sufficient clicking touch.

Moreover, the reset springs 32 of the operation plunger 31 are placed in a dispersed manner, a difference tends to occur in the deformed degree of the group of the reset springs depending on positions at which the operation plunger 31 is pressed, resulting in a different operation load.

SUMMARY OF THE INVENTION

The present invention has been devised to solve the above-mentioned problems, and its objective is to provide a push-button switch which has a thinner structure as a whole, can be switched on with the same operation load whichever portion thereof is pressed, and has superior operability with an accurate clicking touch.

In order to achieve this objective, the present invention has the following arrangement.

A push-button switch of the present invention, which actuates a switch main body that is assembled in a base member by pressing an operation plunger, is provided with a plurality of operation members, each having an operation end and an actuation end used for a switching operation, which are placed on the base member so as to be freely rocked, and in this arrangement, each operation member has its operation end aligned face to face with the operation plunger so that the switching main body is actuated by the operation member that is rocked and shifted in response to the pressing operation of the operation plunger.

In accordance with the present invention, when the operation plunger is pressed, any one of the operation members is operated so as to rock so that the switch main body is actuated.

In one aspect of the present invention, the operation members are arranged on a plane in a dispersed manner so as to be placed outwards from the center of the base member in a radial manner, with each actuation end being positioned in the center and each operation end being positioned on the outside.

Here, the term, "in a radial manner", refers to an arrangement formed so as to expand outwards from the center portion, and, for example, the operation ends of the operation members are placed in a manner so as to extend outwards, for example, in four directions from the center portion.

Moreover, it is not necessary to place all the portions of the operation members on the same plane, and, for example, the operation members are partially bent, and portions of the operation members may be placed on the same plane in a dispersed manner.

In the present invention, the respective operation ends of the operation members are placed in a radial manner so as to expand outwards so that whichever portion of the operation plunger may be pressed, the corresponding operation member is positively rocked and shifted, and since these members are placed on a plane in a dispersed manner, it is possible to make the structure thinner.

In another aspect of the present invention, the actuation end of each operation member is placed adjacent to a reset spring plate so that the switch main body is actuated through the reset spring plate.

In accordance with the present invention, when the operation plunger is pressed, at least one of the operation members is operated to rock with the reset spring plate being elastically deformed; thus, the switch main body is activated in cooperation with the deformation of the reset spring plate, and in contrast, when the pressing force of the operation plunger is released, the reset spring plate is elastically reset, thereby allowing the operation member to rock and return to its original state. Moreover, whichever operation member may be operated, the corresponding reset spring plate is elastically deformed to actuate the switch main body; thus, whichever portion of the operation plunger may be pushed, the same operation load that is specified by the reset spring can be applied.

In still another aspect of the present invention, the operation members are connected to one another through connecting arm portions so as to form an integral part.

In accordance with the present invention, since the operation members are integrally formed into one part, it is possible to reduce machining costs, and since the operation members are assembled to a predetermined portion as one lot, it is possible to improve the assembling workability, and consequently to reduce the costs.

In still another aspect of the present invention, a central eccentric portion of a wire that has two ends secured to fixed positions is engaged by the reset spring plate so that, when the reset spring plate is shifted in response to the pressing operation of said operation plunger, the pressing direction of the wire is inverted.

In accordance with the present invention, an arc shaped locus through which the eccentric center portion of the wire is allowed to rotate and shift with both of its ends serving as fulcrums and a locus of the shift of the engaging point of the reset spring plate are different from each other, with the result that a great difference occurs in the deforming load of the reset spring plate before and after the passage through the neutral point; thus, this forms a clicking touch in the operation load to provide a sufficient clicking touch without impairing the thin structure.

DESCRIPTION OF THE PREFERRED EMBODIMENTS

Referring to Figures, the following description will discuss embodiments of the present invention.

Figure 1:
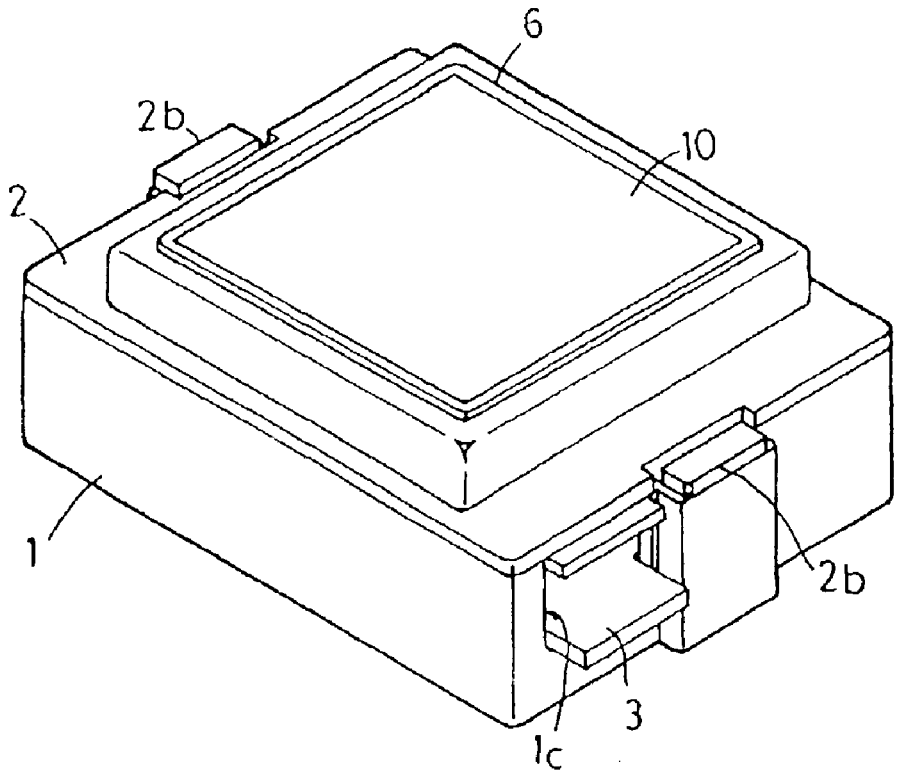
FIG. 1 shows a perspective view that indicates the entire structure of a push-button switch.
Figure 2:
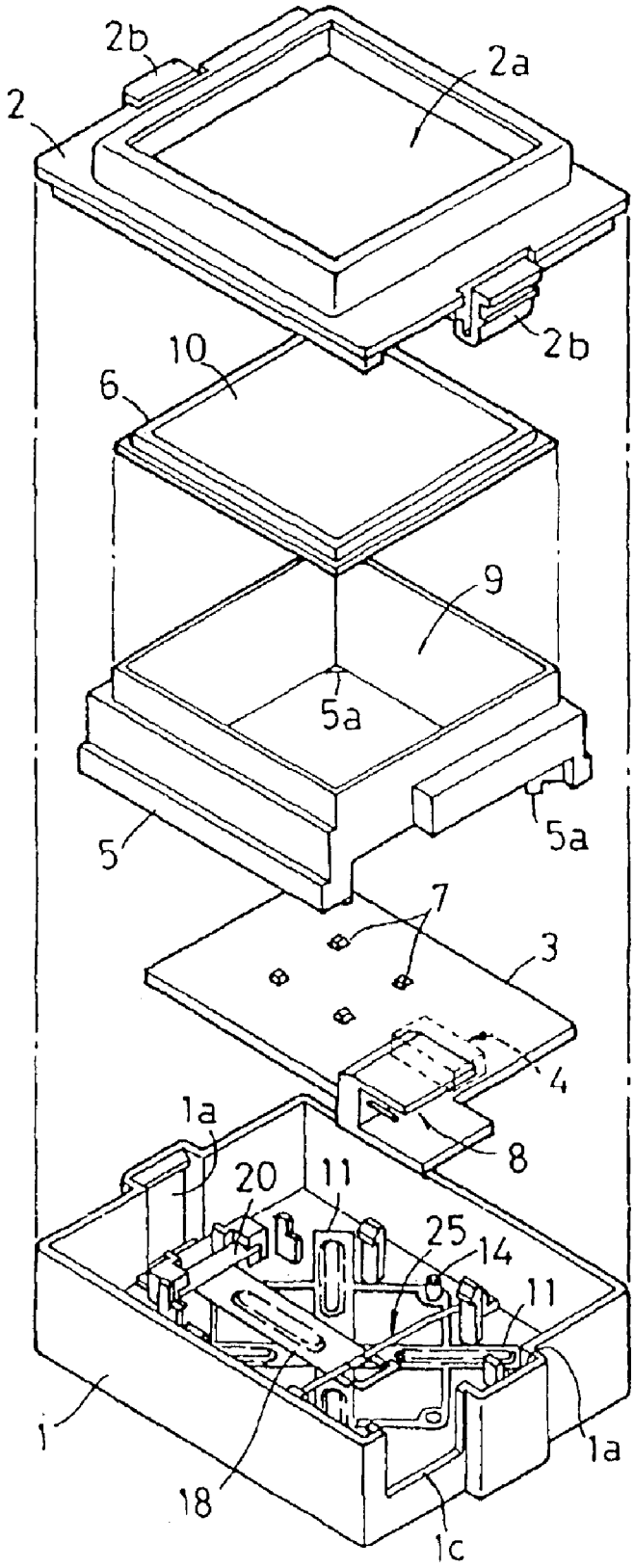
FIG. 2 shows an exploded perspective view of the push-button switch.
Figure 3:
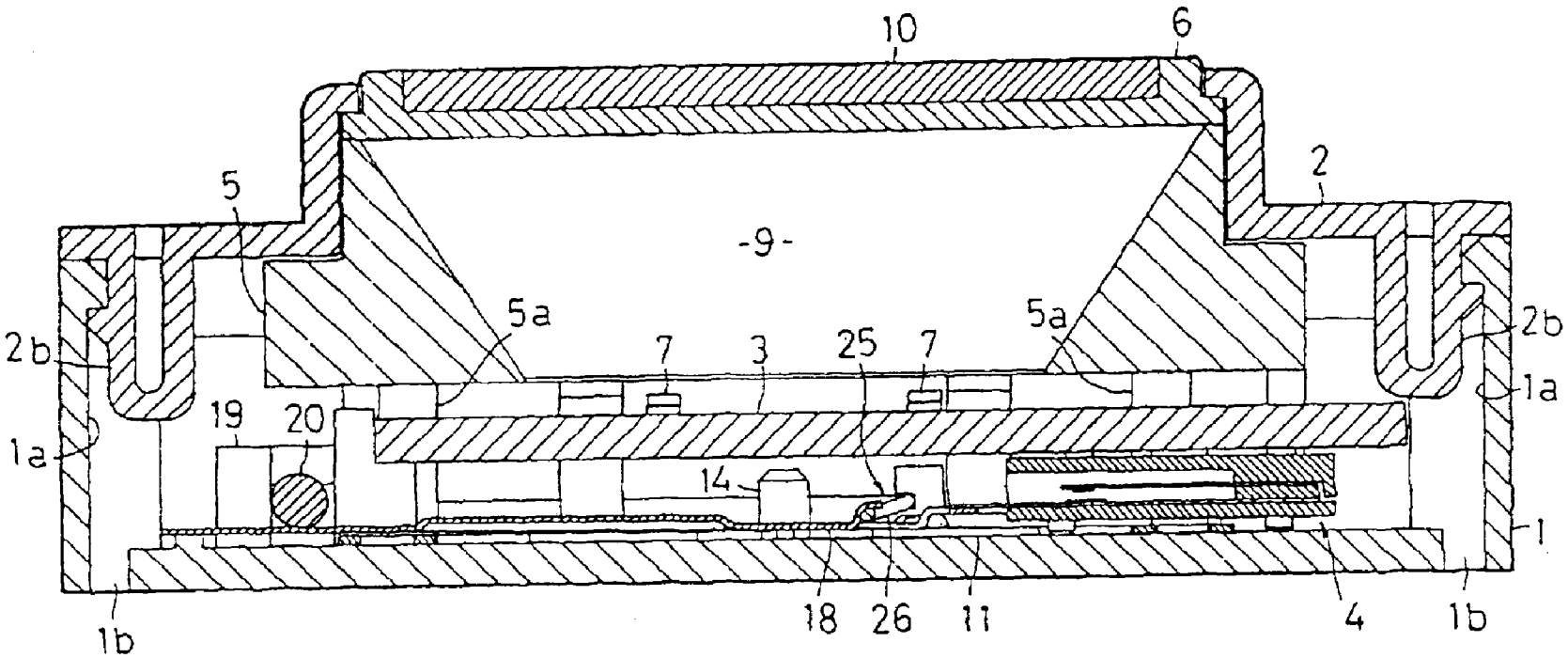
FIG. 3 shows a longitudinal cross-sectional view of the push-button switch.

FIG. 1 shows a schematic outside drawing of a push-button switch in accordance with the present invention, FIG. 2 shows an exploded perspective view of the switch, and FIG. 3 shows its cross-sectional view.

This push-button switch is constituted by a base member 1 that is molded into a shallow box shape, a cover 2 with an opening 2*a* that covers this, a base plate 3 that is assembled into the inner center of the base member 1, a switch main body 4 that is attached to the lower surface of the base plate 3, an operation plunger 5 that is attached to the opening 2*a* of the cover 2 from the inside so as to freely slide in up and down directions, a push button 6 that is placed at the upper end of the operation plunger 5 so as to face the operation hole 2*a* of the cover 2, etc.

Engaging claws 2*b* having a U-letter shape are attached to the right and left ends of the cover 2, and by inserting these engaging claws 2*b* into connecting recessed sections la formed in the right and left ends of base member 1, the cover 2 is secured to the base member 1, and by inserting a tool such as a driver from a slit 1*b* formed in the bottom of each connecting recessed section 1*a* so as to make the engaging claws 2*b* retreat and deform, the connection can be released.

A LED 7, which is turned on to indicate the operating state of the switch, is placed on the upper face of the base plate 3, and a connector 8 to be used for inputting and outputting signals is attached to one end of the base plate 3, and a connecter used for external wiring is connected to this through an opening 1*c* formed on a side face of the base member 1.

The operation plunger 5 is provided with a light-directing hole 9 which has a shape that is widened upward so as to also function as light-shielding member with respect to the LED 7, and a push-button 6, which is placed so as to shield the upper end of the light-directing hole 9, and made of a light-transmitting resin member, has an upper face to which a pressing operation plate 10 made of a light-transmitting resin member is fitted and attached. Moreover, operation protrusions 5*a* are formed on the four corners of the operation plunger 5 in a manner so as to stick out downward.

Figure 4:
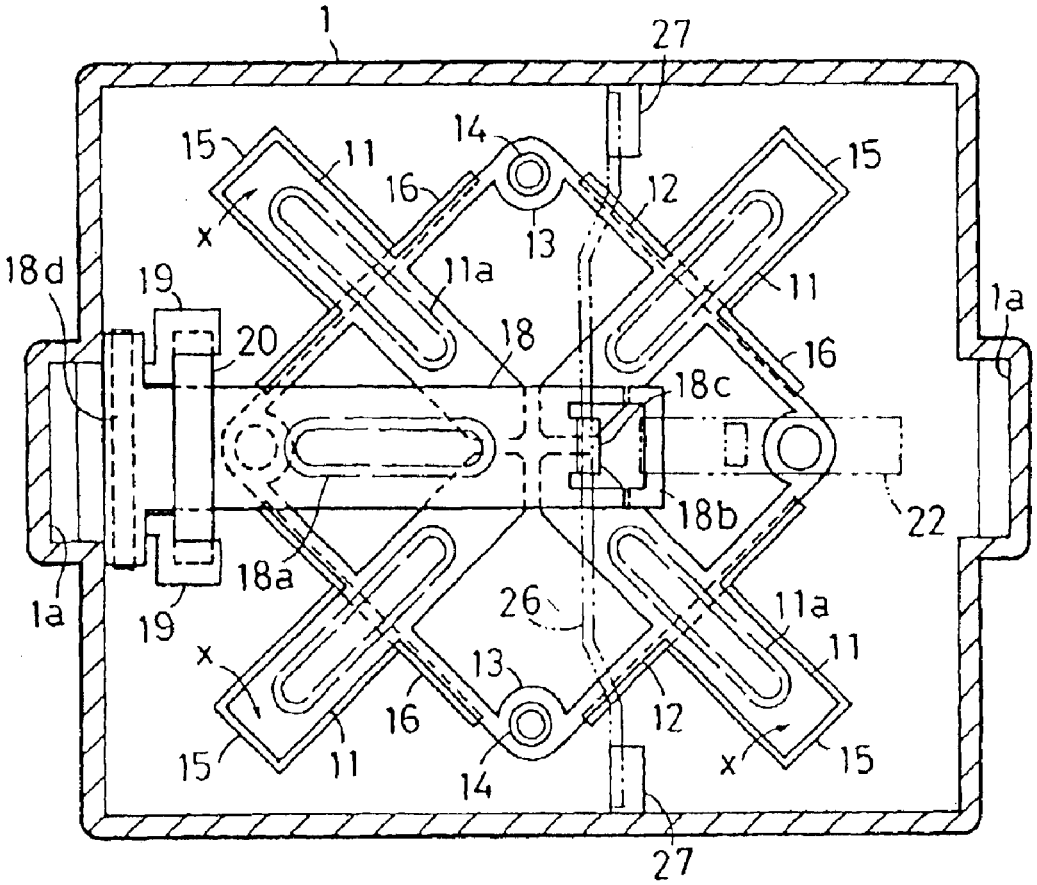
FIG. 4 shows a plan view that indicates an essential portion thereof.

As shown in FIG. 4, four switching-operation-use operation members 11 are placed on the bottom face of the base member 1. These operation members 11 are placed so as to diagonally spread from the center of the base member 1 toward the four corners thereof so that the outside ends of the respective operation members 11 are placed to face the operation protrusions 5*a* of the operation plunger 5 as operation ends x, with the inside ends of the respective operation members 11 being butted with each other as actuation ends y. In other words, the operation ends x of the respective operation members 11 are placed in a radial manner so as to extend toward the four corners from the center portion of the base member 1.

Figure 5:
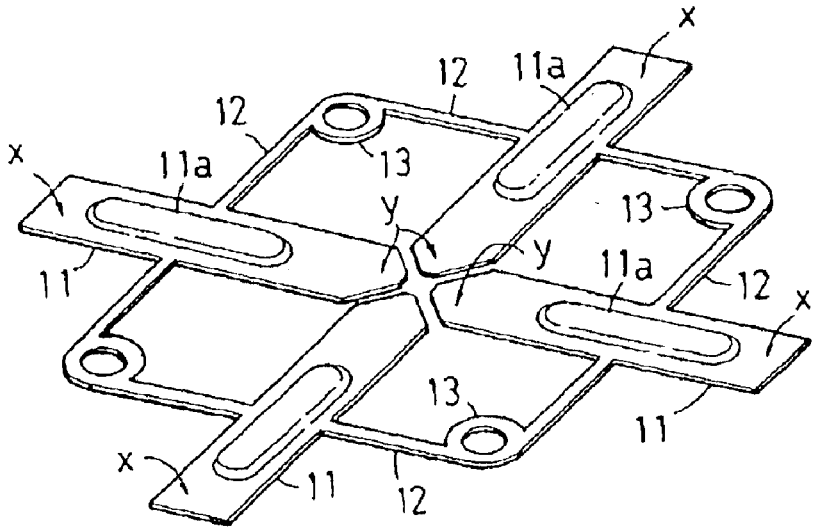
FIG. 5 shows a perspective view that indicates an operation member.
Figure 9A:
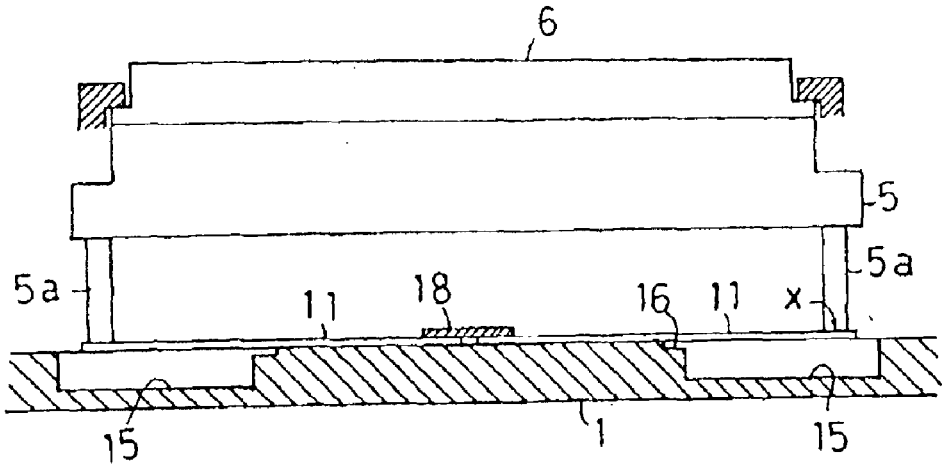
FIGS. 9A, 9B and 9C shows a schematic cross-sectional view that explains operations of a reset spring plate.

As shown in FIG. 5, these four operation members 11 are connected to one another at each middle portion in the length direction by connecting arms 12 having a small width to form an integral part, and support portions 13, formed at the middle of these connecting arms 12, are inserted into a pair of supporting pins 14 that are formed on the bottom face of the base member 1 in a manner so as to stick out, to be supported therein, so that the entire group of the operation members 11 is supported along the bottom face of the base member 1. Further, a recessed section 15 that faces each operation end x from the arm connecting portion of each operation member 11 and a groove 16 that stretches below the connecting arm 12 are formed on the bottom face of the base member 1, and as shown in FIG. 9, when the operation end x of each operation member 11 is pressed downward to be inserted into the recessed section 15, the operation member 11 is rocked like a balance centered on the edge e of the groove 16 so that the inside actuation end y is allowed to shift upward. Here, a reinforcing rib 11*a* is formed so as to protrude, within a length range including the rocking fulcrum portion of each operation member 11 so that an appropriate rocking movement like a balance is carried out without causing a deformation in the operation member 11.

Moreover, as shown in FIGS. 3 and 4, a reset spring plate 18 that extends from the vicinity of the base circumferential wall to the center having a laterally elongated form is placed in the base member 1. The reset spring plate 18 has its widened outer end portion 18*d* inserted between the inner face of the circumferential wall and the positioning protrusions 19 that stick out from the base bottom face so that it is engaged and stopped so as not to shift laterally, with the outer end side of the reset spring plate 18 being pressed by the pin 20 that is passed and fixed between a pair of the positioning protrusions 19; thus, the reset spring plate 18 is supported with its idle end side being elastically shifted vertically with the pressed portion by the pin 20 serving as a fulcrum p shown in FIGS. 6, 7, which will be described later. Then, as shown in FIG. 4, the idle end side of this reset spring plate 18 is placed on the butted portions of the group of operation members 11 in an overlapped manner so that any one of the operation members 11 is rocked like a balance to shift the actuation end x upward, thereby allowing the idle end side of the reset spring plate 18 to shift upward. Here, the reinforcing rib 18*a* is also formed in a protruding manner in the reset spring plate 18.

Figure 9B:
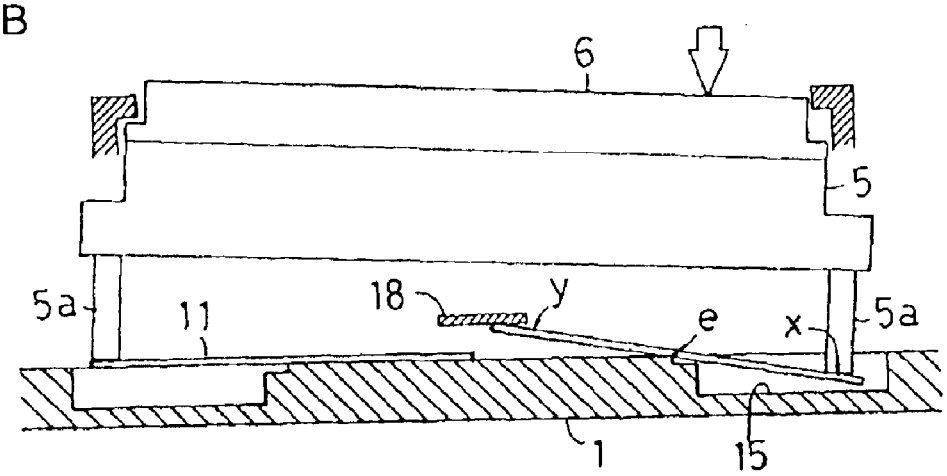
Figure 9C:
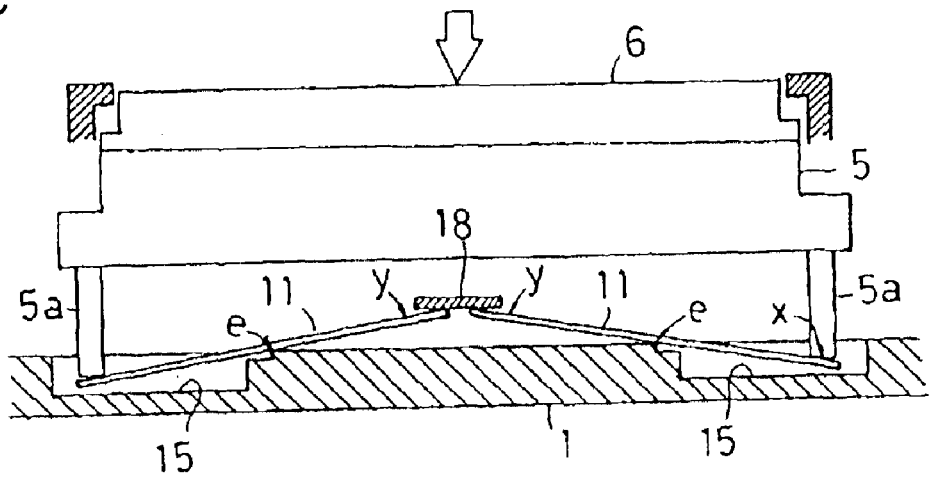

Therefore, as shown in FIG. 9B, in the case when the end of the push button 6 is pressed and the operation plunger 5 is pushed in, only the operation member 11 on the pushed side is allowed to rock like a balance, and the reset spring plate 18 is elastically deformed with its idle end side being raised and shifted by the actuation end y of the operation member 11. Here, as shown in FIG. 9C, in the case when the center portion of the push button 6 is pressed so that the operation plunger 5 is pushed in a parallel manner, all the operation members 11 are operated so as to rock like a balance so that the idle end side of the reset spring plate 18 is pushed and shifted upward. When the pushing operation to the push button 6 is released, the idle end side of the reset spring plate 18 is lowered by the elastic resetting force so that the actuation ends y of the operation members 11 are pushed down with the operation ends x of the operation members 11 being pushed upward; thus, the operation plunger 5 is reset to shift to the upper limit.

Figure 10A:
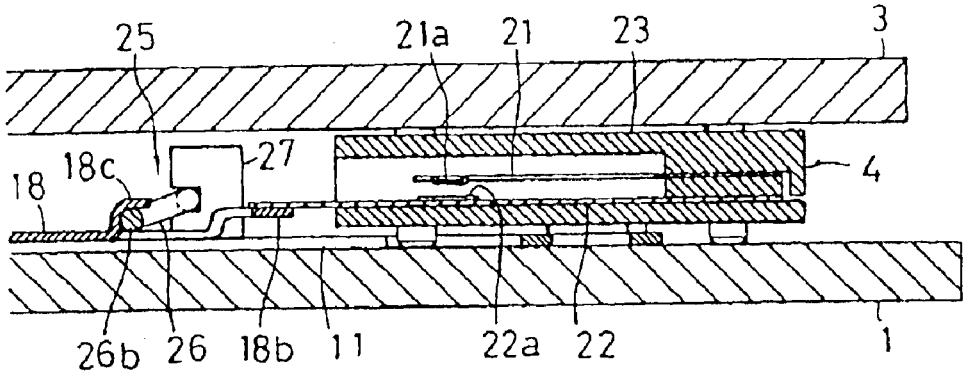
FIGS. 10A, 10B and 10C shows a cross-sectional view of an essential portion, which explains operations of a switching action.
Figure 10B:
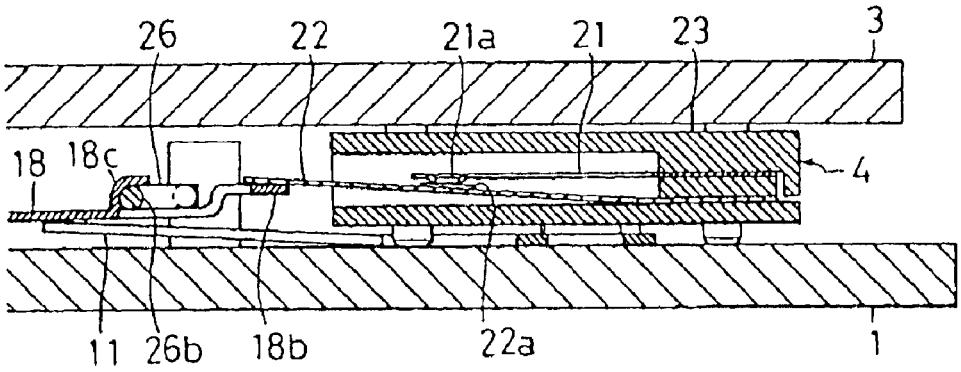
Figure 10C:
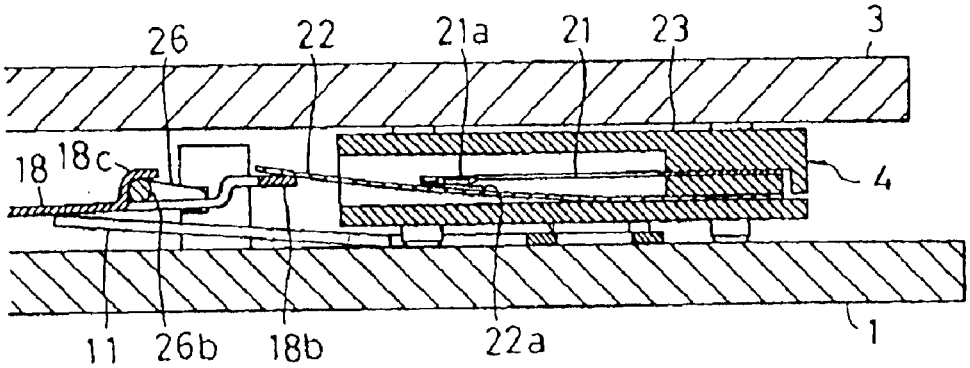

Moreover, as shown in FIG. 10, the above-mentioned switch main body 4 is arranged as a leaf switch in which a fixed electrode member 21 and a movable electrode member 22 facing this from the lower side are supported by an insulating member 23 in a cantilever shape, and the movable electrode member 22 is further extended to be superposed over the idle end 18*b* of the reset spring plate 18. Therefore, when the reset spring plate 18 is operated to be pushed up by the rocking action like a balance of the operation member 11, the movable electrode member 22 is pushed up and deformed by the idle end 18*b* of the reset spring plate 18, as shown in FIGS. 10B and 10C so that the contact 22*a* of the movable electrode member 22 is pressed onto the contact 21*a* of the fixed electrode member 21; thus, the switch is turned on so that the LED 7 is lighted on with a switch output being released.

Figure 6:
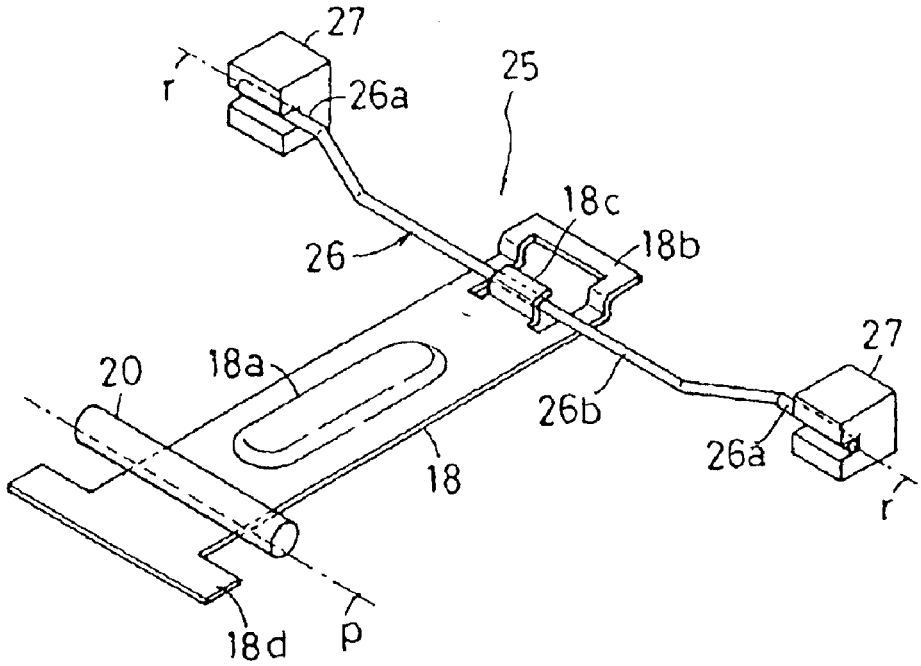
FIG. 6 shows a perspective view that indicates a reset spring plate and a snap action mechanism.
Figure 7:
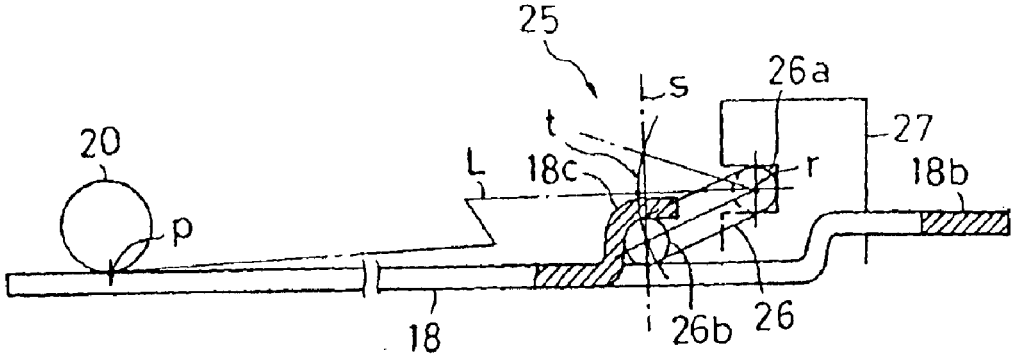
FIG. 7 shows a cross-sectional view of an essential portion that explains operations of the snap action mechanism.

Moreover, a snap action mechanism 25 is connected to the idle end side of the above-mentioned reset spring plate 18 so as to provide a clicking touch. As shown in FIGS. 6 and 7, this snap action mechanism 25 has an arrangement in which two ends 26*a* of a wire 26 made of a spring wire member that is bent and formed into a crank shape are inserted into supporting portions 27 that are formed on a base member 1 in a protruding manner to be secured to fixed positions, with a center eccentric portion 26*b* of the wire 26 being engaged and stopped by a wire supporting portion 18*c* that is formed in the reset spring plate 18 as a cut-out bent portion; thus, the center eccentric portion 26*b* of the wire 26 is allowed to rotate with the two ends 26*a* serving as rotation centers r.

With this arrangement, as shown in FIG. 10A, in a switch-off state with the reset spring plate 18 being located at the reset position, the center eccentric portion 26*b* of the wire 26 is located below the rotation centers r of the wire 26. When the operation plunger 5 is pushed down from this state so that the idle end side of the reset spring plate 18 is shifted upward, the center eccentric portion 26*b* of the wire 26 is raised, and in this case, as shown in FIG. 7, the wire supporting portion 18*c* of the reset spring plate 18 is shifted along a virtually straight line locus s, while the center eccentric portion 26*b* of the wire 26 has an arc shaped locus t; thus, as the wire supporting portion 18*b* is raised, the center eccentric portion 26*b* of the wire 26 is elastically deformed toward the rotation fulcrum r side so that the elastic resetting force of the wire 26 is exerted to press the wire supporting portion 18*c* toward the base side of the reset spring plate 18.

In this case, while the center eccentric portion 26*b* is located below a hypothetical line L connecting the fulcrum p of the reset spring plate 18 and the rotation fulcrum r of the wire 26, the wire supporting portion 18*c* is pressed downward by the downward component of the elastic reset force of the wire 26 so that the elastic reset force of the wire 26 forms a resisting force against the upward shift of the reset spring plate 18, that is, an operation resisting force to push the operation plunger 5. When the center eccentric portion 26*b* goes above the hypothetical line L connecting the fulcrum p of the reset spring plate 18 and the rotation fulcrum r of the wire 26, the elastic reset force of the wire 26 comes to have a component for pressing the wire supporting portion 18*c* upward so that the elastic reset force of the wire 26 is switched to a pressing force for accelerating the upward shift of the reset spring plate 18.

Figure 8:
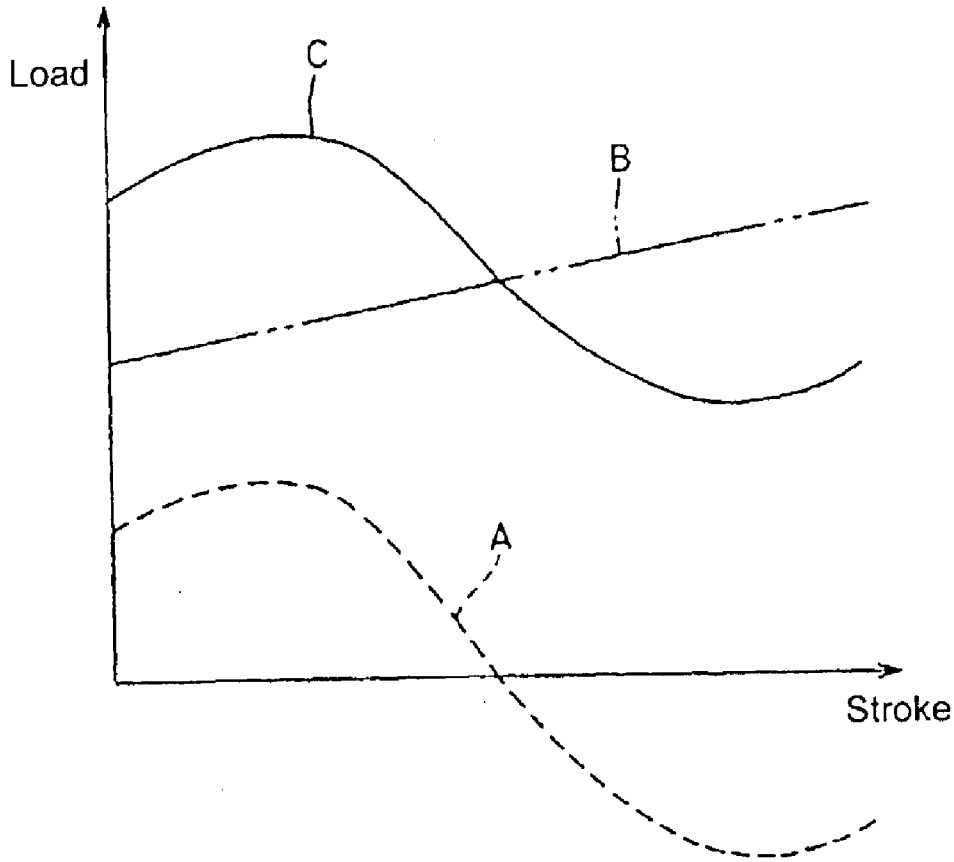
FIG. 8 shows a line drawing that indicates a characteristic of an operating load with respect to a stroke of an operation plunger.

A dot line A in FIG. 8 shows a characteristic drawing in which the elastic force of the wire 26 in the above-mentioned snap action mechanism 25 is converted to a load for operating the stroke of the operation plunger 5, and a two-dot chain line B shows a characteristic drawing in which the elastic force of the reset spring plate 18 is converted to a load for operating the stroke; thus, the actual load for operating the stroke of the operation plunger 5 forms a characteristic indicated by a solid line C which has both of the characteristics in a composite manner, thereby providing a good clicking touch.

Here, the present invention may be carried out by the following embodiment.

Figure 11:
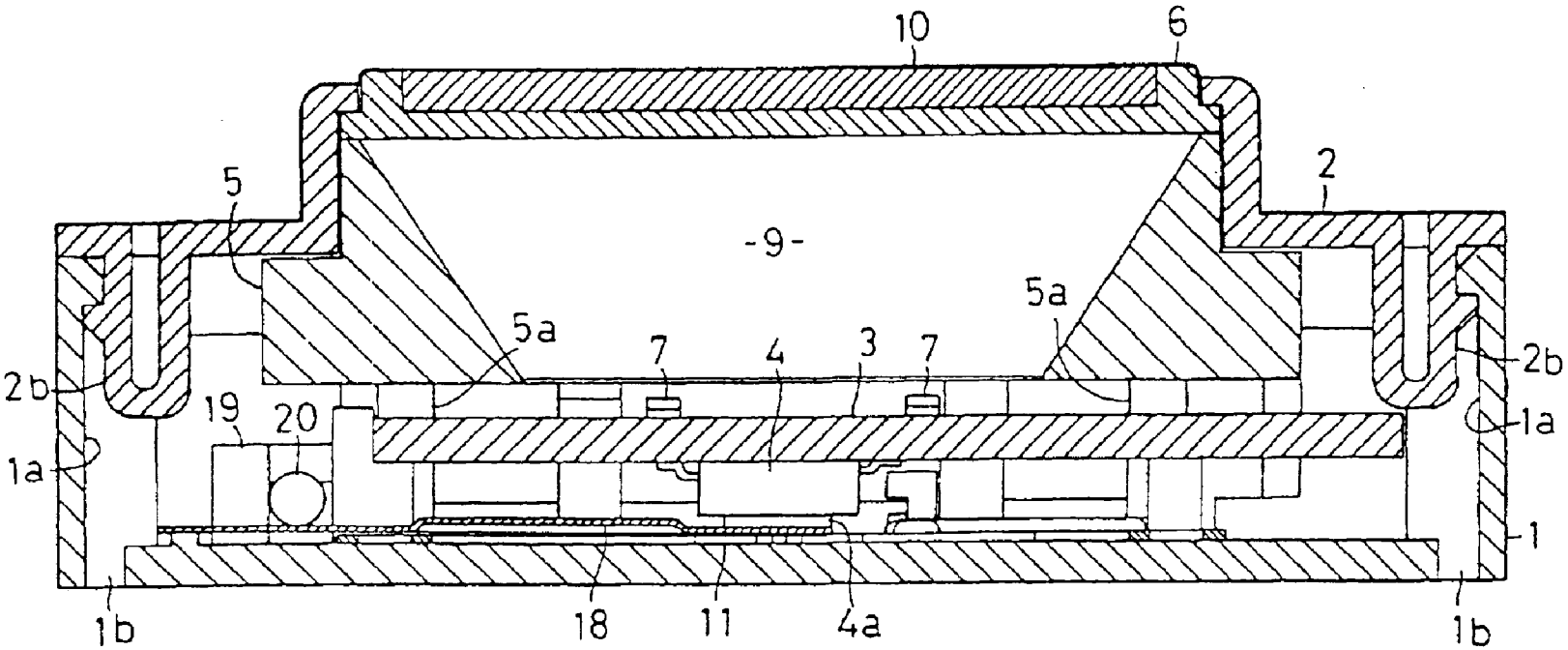
FIG. 11 shows a longitudinal cross-sectional view that indicates a push-button switch of another embodiment.

(1) Besides the above-mentioned leaf switch, the switch main body 4 may utilize various switching mechanisms, and, for example, as shown in FIG. 11, a conventional tactile switch is attached to the lower face of a base plate as the switch main body 4 so that its operation unit 4*a* may be push-in operated by the idle end 18*a* of the reset spring plate 18.

In this case, the tactile switch is arranged to provide a clicking touch in the actuation of the operation unit 4*a*; thus, different from the above-mentioned example, it is not necessary to provide an exclusively-used snap action mechanism 25.

(2) With respect to the number of the above-mentioned operation members 11, not limited to the number exemplified above, the number may be increased or decreased depending on the size, etc. of the operation plunger 5. Moreover, it is convenient to form all the operation members 11 as an integral part as exemplified above from the viewpoint of assembling; however, depending on layout conditions and shapes of the operation members 11, a set of a plurality of these members may be integrally formed and a plurality of these sets may be respectively attached to the base member 1, or all the operation members 11 may be formed as independent parts, and these may be attached to the base member 1 independently.

(3) The actuation end of each operation member 11 may be aligned face to face with the movable electrode member 22 of the leaf-type switch main body 4 or the operation unit 4*a* of the tactile-type switch main body 4 so that the switch main body 4 can be operated without using the reset spring plate 18. Here, in the arrangement in which the leaf-type switch main body 4 is operated by each operation member 11, the elastic characteristic of the movable electrode member 22 is set so as to allow the elastic reset force of the movable electrode member 22 to serve as the plunger reset force.

Figure 12:
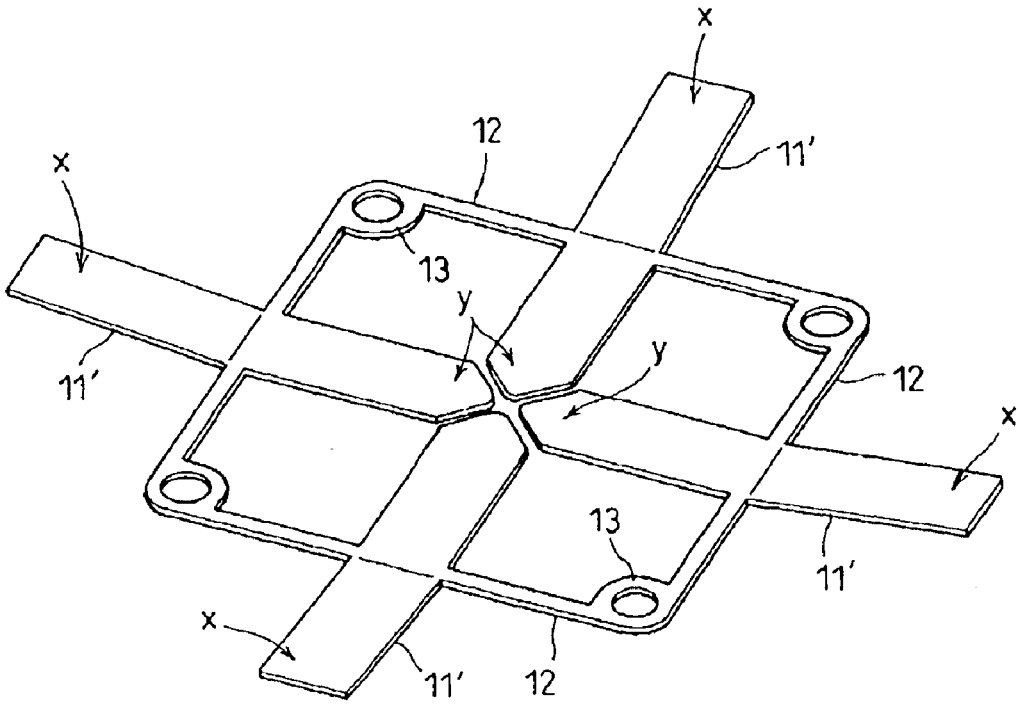
FIG. 12 shows a perspective view of another example of an operation member.
Figure 13A:
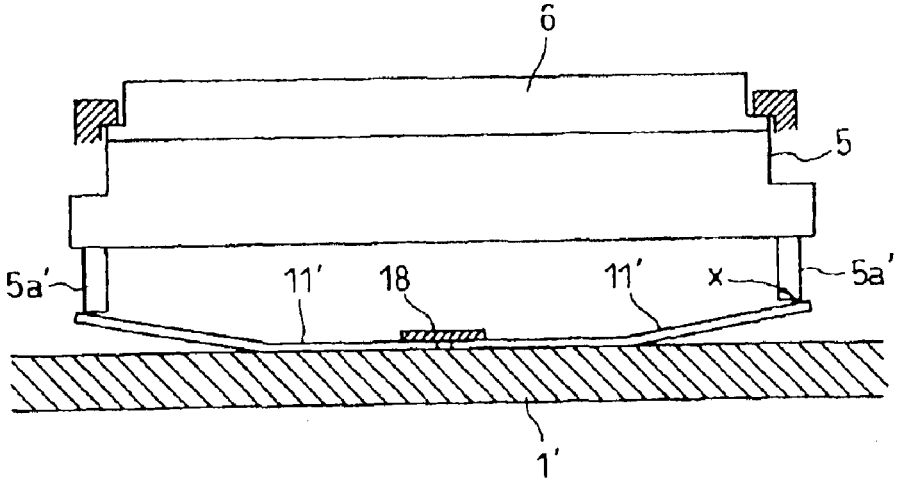
FIGS. 13A and 13B shows a schematic cross-sectional view that explains operations of the operation member shown in FIG. 12.
Figure 13B:
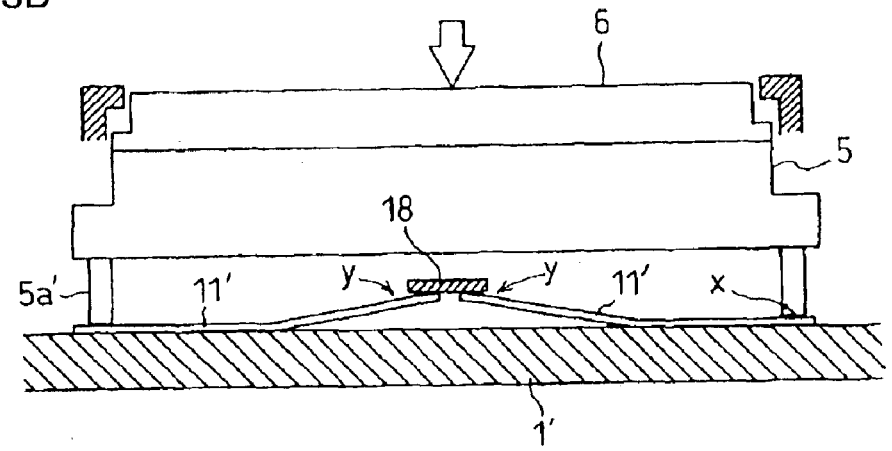
Figure 14:
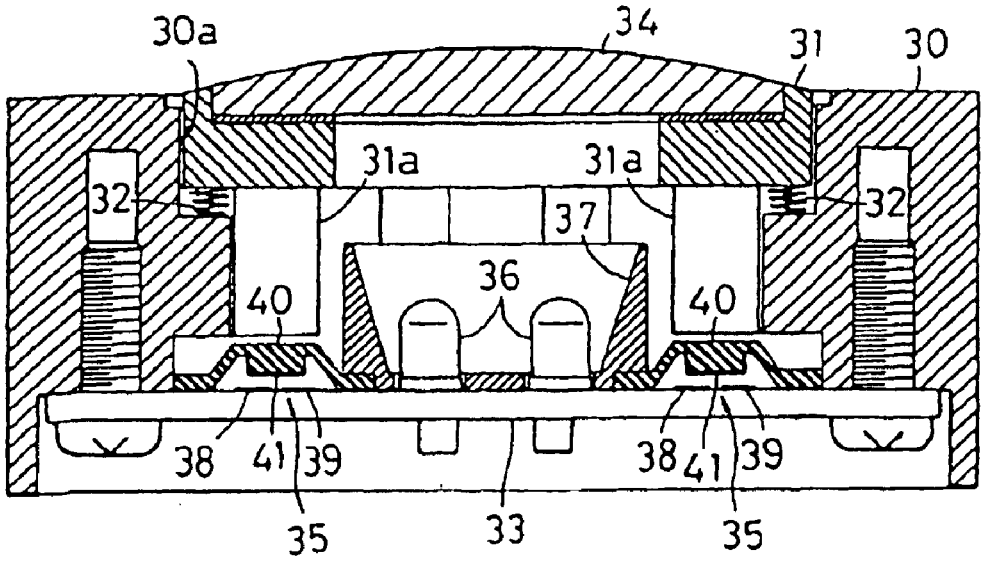
FIG. 14 shows a longitudinal cross-sectional view that indicates a conventional push-button switch.
Figure 15:
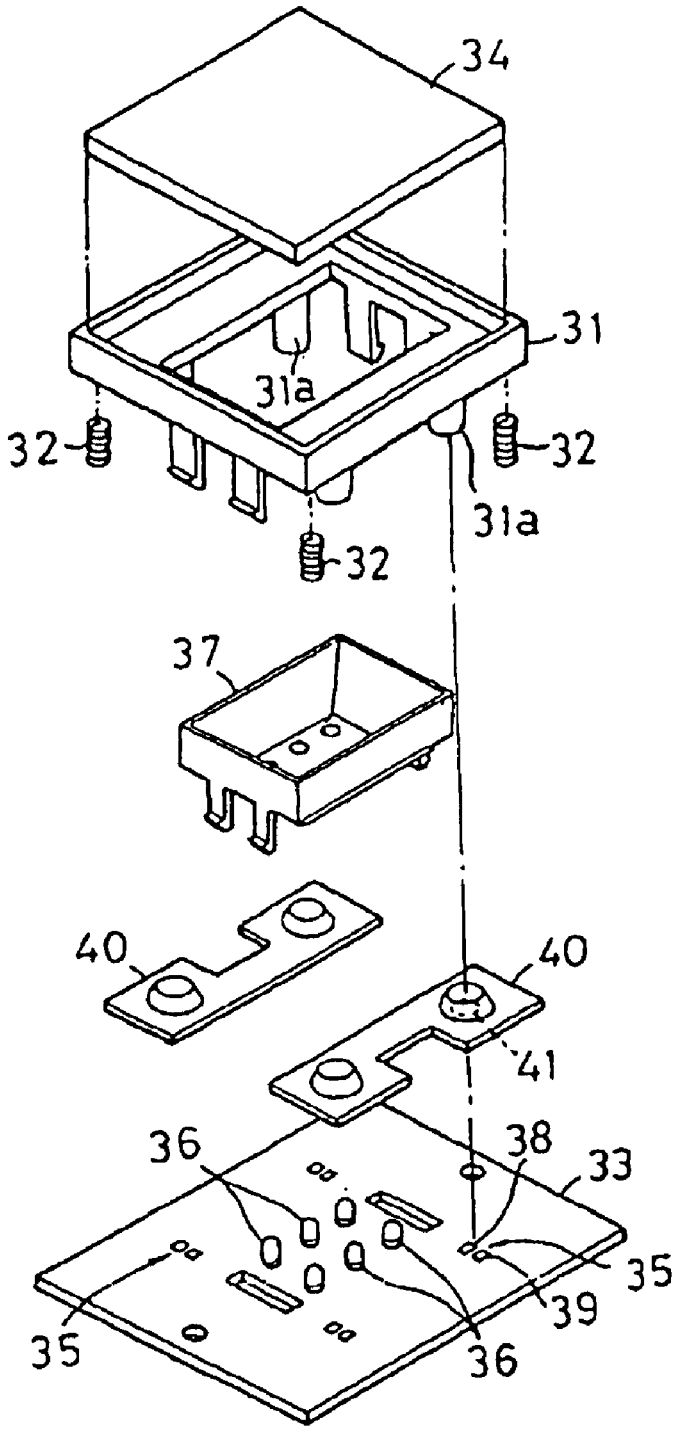
FIG. 15 shows an exploded perspective view that indicates a conventional push-button switch.

(4) In the above-mentioned embodiment, the respective operation members 11 are formed on the same plane, and the recessed-section 15 is formed on the bottom face of the base member 1 so that each operation member 11 is placed so as to rock freely; however, in another embodiment of the present invention, as shown in FIGS. 12 and 13, another arrangement may be provided in which: each operation member 11' is formed to have a bent shape, and placed so as to rock freely without forming a recessed section in the base member 1' so that an operation protrusion 5*a*' of the operation plunger 5 may push down the operation end x of the operation member 11' through the pressing operation of the push button 6. Here, a reinforcing rib may of course be formed in the operation member 11'.

As described above, in accordance with the present invention, since a plurality of operation members are placed on a plane in a scattered manner so as to actuate the switch main body, it is possible to provide a thinner structure and also to carry out the switching operation with the same characteristics, whichever portion of the operation plunger may be pressed.

Moreover, since the reset spring plate is allowed to act on a plurality of operation members, the same operation load is applied whichever portion of the operation plunger may be pressed; thus, it becomes possible to effectively stabilize the operation characteristics.

Furthermore, by using a simple structure in which the center eccentric portion is engaged and stopped by the reset spring plate with the two ends of the wire being secured to fixed positions, it is possible to form a snap action mechanism and consequently to provide a sufficient clicking touch, while achieving a simple assembling process with ease by using a small space; thus, it becomes possible to further improve the operability without impairing the thin structure.

What is claimed is:

1. A push-button switch, which is allowed to actuate a single switch main body having a single contact that is assembled in a base member by pressing an operation plunger, comprising:

a plurality of operation members for said single switch main body, each having an operation end and an actuation end used for a switching operation by actuating said single contact, which are placed on said base member so as to be freely rocked, wherein each operation member has said operation end thereof aligned face to face with said operation plunger so that said single contact of said single switch main body is actuated by said operation member that is rocked and shifted in response to the pressing operation of the operation plunger.

2. The push-button switch according to claim 1, wherein said operation members are arranged on a plane in a dispersed manner so as to be placed outwards from the center of said base member in a radial manner with said actuation end being positioned in the center and said operation end being positioned on the outside.

3. The push-button switch according to claim 2, wherein said actuation end of each operation member is placed adjacent to a reset spring plate so that said switch main body is actuated through said reset spring plate.

4. The push-button switch according to claim 3, wherein a central eccentric portion of a wire that has two ends secured to fixed positions is engaged by said reset spring plate so that when said reset spring plate is shifted in response to the pressing operation of said operation plunger, the pressing direction of said wire is inverted.

5. The push-button switch according to claim 1, wherein said operation members are connected to one another through connecting arm portions so as to form an integral part.

6. The push-button switch according to claim 1, wherein said operation end of each operation member is inserted into a recessed portion of the base member when said operation end is rocked and shifted in response to the pressing operation of the operation plunger.

7. The push-button switch according to claim 1, wherein said actuation end of each operation member actuates the switch main body through a reset spring plate.

8. A push-button switch, which is allowed to actuate a switch main body that is assembled in a base member by pressing an operation plunger, comprising:

a plurality of operation members, each having an operation end and an actuation end used for a switching operation, which are placed on said base member so as to be freely rocked, wherein each operation member has said operation end thereof aligned face to face with said operation plunger so that said switch main body is actuated by said operation member that is rocked and shifted in response to the pressing operation of the operation plunger, wherein said operation members are arranged on a plane in a dispersed manner so as to be placed outwards from the center of said base member in a radial manner with said actuation end being positioned in the center and said operation end being positioned on the outside.

* * * * *